United States Patent [19]

Lingl, Jr.

[11] 4,179,959

[45] Dec. 25, 1979

[54] METHOD AND APPARATUS FOR THE CUTTING OF SPLIT TILES

[75] Inventor: Hans Lingl, Jr., Paris, Tenn.

[73] Assignee: Lingl Corporation, Paris, Tenn.

[21] Appl. No.: 846,938

[22] Filed: Oct. 31, 1977

[30] Foreign Application Priority Data

Oct. 29, 1976 [DE] Fed. Rep. of Germany ..... 2649409

[51] Int. Cl.[2] ..... B26D 1/56

[52] U.S. Cl. ..... 83/37; 83/49; 83/51; 83/52; 83/300; 83/303; 83/307.2; 83/318; 83/578

[58] Field of Search ..... 83/578, 303, 300, 307.2, 83/310, 318-320, 51, 52, 49, 487, 488, 37

[56] References Cited

U.S. PATENT DOCUMENTS

| | | | |
|---|---|---|---|
| 2,641,041 | 6/1953 | Gano | 83/318 X |
| 2,641,042 | 6/1953 | Kopp | 83/318 X |
| 2,936,664 | 5/1960 | Myers | 83/487 |
| 3,176,564 | 4/1965 | Jones et al. | 83/578 X |
| 3,301,115 | 1/1967 | Walsh | 83/578 X |
| 3,413,881 | 12/1968 | Stolzer | 83/578 X |
| 3,768,350 | 10/1973 | Coulter | 83/51 |
| 3,933,067 | 1/1976 | Clark | 83/578 X |

*Primary Examiner*—Frank T. Yost

*Attorney, Agent, or Firm*—Cushman, Darby & Cushman

[57] ABSTRACT

Method and apparatus for cutting extruded split tile columns in a quick, efficient manner that reduces the possibility of damage and effectively doubles cutting speed. The apparatus cuts the moving split tile column as it moves away from the extruder and includes oppositely mounted, freely movable cutting discs which roll through and cut that split tile column when moved vertically therethrough. Cutting occurs on both up and down strokes with the cutting apparatus being moved relative to the moving column to a predetermined amount to a new cutting position after each stroke. The discs can be mounted in the same plane, arranged 90° to the column's moving direction positioned so as to just touch each other or the discs can be in two separate and slightly offset planes so that the discs can overlap. Alternatively the discs could be spaced apart a predetermined distance and a secondary cutter used in a following manner to finish cutting a very narrow portion in the center of the column comprised of the rib and rear tile surface.

18 Claims, 6 Drawing Figures

METHOD AND APPARATUS FOR THE CUTTING OF SPLIT TILES

This invention relates generally to method and apparatus for further aiding the manufacturing of split tiles and in particular an improved method and apparatus for cutting extruded hollow-walled split tile columns into predetermined portions.

Split tiles, per se, are described fully in a copending U.S. Patent Application, Ser. No. 478,036 filed on June 10, 1974, now abandoned in favor of a Continuation-in-Part Application Ser. No. 639,346 filed on Dec. 10, 1975, in a Divisional Application Ser. No. 557,222 filed on Mar. 10, 1975, now U.S. Pat. No. 3,976,417, and a Continuation-in-Part Application Ser. No. 524,998 filed on Nov. 18, 1974. In addition, another method of automatically manufacturing split tiles is set forth in a copending U.S. Patent Application Ser. No. 654,168 filed on Feb. 2, 1976 and Divisional Application Ser. No. 806,294 filed on June 13, 1977. The disclosure of all these co-pending applications is hereby expressly incorporated by reference.

BACKGROUND OF THE INVENTION

Split tiles, per se, are formed by extruding a raw clay material in a hollow-walled manner providing two relatively thin outer sidewalls on either side of the longitudinal extrusion axis. The sidewalls are separated by a rib structure and the exterior of the sidewalls may be stamped or pressed with a desired tile geometry (perhaps ornamental). The hollow column is cut into appropriate or predetermined lengths (either before or after stamping) which lengths are then hacked and fired. The final desired ceramic tile product is produced by splitting the fired hollow wall structure and by breaking out any previously stamped tile geometries.

The automatic extrusion cutting and/or stamping of split tile structures as well as the automatic spaced-apart placing of cut lengths of pallets for drying purposes is described in my aforesaid co-pending applications and/or is otherwise known in the art. However, such known methods and apparatus for cutting extruded hollow-walled split tile columns have not provided the ease for efficiencies provided by the present invention and required much greater processing times.

Of the known methods for cutting extruded columns one employs wires or stamping tools arranged to approach an extruded column to complete the cut. When cutting high tile columns with such known prior art wire cutters, the wire has been known to bend to the point where a cut is not fully completed, constituting a serious disadvantage. Likewise, the edges from which the wire cutter exits must be properly supported so that corners or areas along the cut line will not be lifted off as a wire exits the column. It is also known that extruded columns have an extrusion skin which can be torn by the friction created when cutting tools enter the column from the side, resulting in deformation near the edge of the tile along the cut line.

Another known cutting approach involves a multistep procedure in which the column is initially grooved by a pinching type of motion along what should be the ultimate cutting line. Thereafter, the grooved column is lifted vertically through a wire cutting frame in which the wires are arranged in a pattern matching the previously formed grooves so that the section becomes divided into predetermined portions of tile lengths. Quite obviously, such a device requires elaborate and time-consuming adjustments prior to cutting in order to properly align the grooving and cutting tools and equally elaborate, time-consuming adjustment when changing to cut different patterns (i.e. when tile lengths are changed). In addition, because cutting wires tend to follow a line of least resistance, which because of laminations within the column may not always be in a straight line, it is difficult to precisely position the groove with the cut line.

A still further cutting system for split tiles makes use of special knives arranged to close in a pinching movement toward the extruded column. Lower parts of such knives groove the column while upper parts, arranged to overlap, cut the column as the knife structure is pulled downward through that column. This cutting system has the distinct disadvantage of not being efficient in its cutting approach since the knife structure only cuts on the downward stroke requiring the structure to be opened, at the bottom of the stroke, lifted vertically to the starting height of the stroke and then closed to the initial cutting position prior to the next cutting cycle. Further, such equipment is mechanically elaborate and to achieve cutting efficiencies necessary for a commercial operation capable of producing necessary production speed requires a great number of knives cutting several tiles simultaneously. Further, it is difficult and time-consuming to adjust this type of apparatus for different cut lengths. Clay varies between lean and fat, plastic or sticky types thus presenting different cutting requirements. When cutting clay columns comprised of a plastic or sticky-type of clay, material tends to stick to knives pulled through the column with the increased bulk causing additional deformation of the tile ends, such as, for example, a nose on the tile corner where the knife leaves the tile column.

Yet another approach for cutting extruded columns is to initially roll a groove into the face of the tile column and thereafter cut the tile with wires arranged to follow the grooving rollers. Again, a disadvantage of using wires as the cutter is that wires tend to follow the line of least resistance which may not necessarily be along a straight line. Thus, changes in the resistance caused by laminations resulting during extrusion may cause the wire cutting tool to deviate from a desired straight line. Accordingly, straight cuts are not assured and likewise there is no assurance that the cut will align with the groove along their entire length of the cut.

SUMMARY OF THE INVENTION

The present invention relates to a method and apparatus for cutting clay columns, for example, hollow-walled split tile columns, by means of disc-like cutting tools having a diameter suitable to produce a cutting angle between the edges of cutting discs and the surface of the column which produces a shearing action thereby preventing tearing of the extrusion skin. The disc-cutting tools are freely rotatable and preferably are not driven although driven disc-like cutting devices could be employed if the rotating speed was greater than the speed at which the cutting stroke was made. The cutting tools are alternately moved upwards and downwards so that the disc-like cutting tools pass through the hollow-walled split tile columns with cutting occurring both on upward and downward strokes. Because the extrusion skin of the column is sheared, the cut is very smooth and there is subtantially no deformation taking place along the cut line. In fact, the resulting tile edges are clean and slightly rounded without deformation. Further, because cutting is accomplished on each up and down stroke, output capacity at a given operating speed can be doubled. In addition, the present invention offers an exceedingly simple cutting system and provides far higher production capacities, high cutting qualities and better quality control, as well as a cutting system easily changed from one tile size to another.

The method of the present invention achieves the cutting of the hollow-walled split tile column into one or more predetermined lengths of tile by means of the disc-like cutting tools positioned with respect to each other such that when the disc-like cutting tools enter the column from the top or bottom, a cutting angle is produced between the edge of the cutting discs and the surface of the column which provides a shearing action. The cutting discs themselves are arranged opposite one another and because they are freely rotatable roll through the column and are driven by the friction existing between the cutting tool and the column itself. At the beginning of a cutting cycle, the discs are positioned either above or below the column. While the extruded column continuously moves in a machine direction, even during the cutting stroke the cutting apparatus moves with the column during cutting so that the column and cutting apparatus are in effect stationary during cutting (i.e. no relative movement therebetween during cutting). When cutting, the discs move either from top to bottom or from bottom to top through the column to produce a cut in each direction. As the extruded column itself moves it is guided on the top and bottom so that the column cannot move a substantial amount during a cutting stroke. Also, since the disc-like cutting tools are mounted in a movable frame which moves with the cutters during cutting, a very straight and accurate cut is achieved. After the cut is completed the cutting apparatus and supporting frame are moved in a counter machine direction a predetermined amount to the next desired cut point at which time the column cutters both move together in the machine direction. Thus, by cutting on each stroke the present method doubles the effective output capacity with respect to other known methods cycling at the same speed.

Additional embodiments of the present invention are also disclosed herein which combine the cutting action of the above-described rolling disc-like cutting tools with following wires or knives. In some instances, as indicated above, clay used in producing extruded columns is sometimes extremely plastic or sticky. In still other instances, the rib structure at the center of the extruded column toward which the rear surfaces of the split tile's face is sometimes extremely fragile or very narrow. In these instances, I have found that it is beneficial if the disc-like cutting tools do not fully penetrate into the column's center. Rather, the discs are spaced apart a distance slightly in excess of the size of the rib structure so that they cut the major thickness of the extruded column but do not penetrate through the rear surface of either of the split tiles. The following wire or knife cutter is then used to cut only the very thin remaining portion of the column comprised of the connecting rib and the extremely thin rear face of each of the split tiles. Using secondary wire or knife cutters in a following action which follow directly along the cutting groove formed by the disc-like cutting tools has not resulted in deviation of the wire or knife-like cutters since only a very thin body of clay is left to cut which offers extremely little resistence.

The above-described embodiments of the present invention together with other objects and novel features and advantages thereof as well as the particular construction, combination and arrangement of parts which comprise the same will perhaps best be understood from the following detailed description when considered in connection with the accompanying drawings which form a part hereof and illustrate a number of various embodiments of the present invention.

DESCRIPTION OF THE DRAWINGS

In the drawings:

Referring now to the drawings wherein like reference numerals refer to like elements, reference is specifically made to the first embodiment of the present invention shown in FIGS. 1 and 2.

The cutting apparatus, generally indicated by reference numeral 10 is comprised of a movable supporting frame or carriage 12 on which vertical support members 14 and 16 are connected, for example by welding, which respectively fix support plates 18 and 20 to frame 12. Such movable frames or carriages for use in cutting or otherwise processing extruded clay columns are known and further description thereof is not deemed necessary in view of the previously referenced patents and applications. It should be noted that support plates 18 and 20 are spaced apart to provide room for the cutting assembly, generally indicated at 22, to pass therethrough. The extruded hollow-walled split tile clay column 24 moves continuously in a machine direction, shown by arrow A, so that during cutting the uncut portion of column 24 is supported by plate 18 while plate 20 supports the cut column piece 26. The operation of the cutting assembly relative to the column will be more fully discussed hereinafter. FIG. 1 shows the apparatus following an upward cut and the letter B indicates the cut line between column 24 and the column piece 26.

A top guide member generally indicated at 28 is comprised of a guide shoe 30, a connecting arm 32 welded or otherwise fixed to a guide shoe 30 and a mounting arm 34 itself connected to a horizontal frame member 36 as by welding or any other convenient means. Frame member 36 is in turn fixed to the top end of vertical guide rods 38 and 40, and the bottom end of rods 38 and 40 are welded or otherwise secured to frame 12. Guide shoe connecting arm 32 is mounted on the mounting arm 34 as for example by bolts 42 which extend through holes 44 provided in connecting arm 32 and mounting arm 34. Thus, the height of guide shoe is adjustable in a vertical direction. As shown in FIG. 2, the clay column 24 is provided along its top and bottom edges with a groove 48 and preferably guide shoe 30 rides in this groove such that the sidewalls of the groove are in contact with the sides of shoe 30. It will be noted that some small amount of space is provided between the bottom surface of guide shoe 30 and the bottom of groove 48. Thus, the primary function of guide shoe 30 is to maintain the attitude of column 24. However, when the cutting assembly 22 cuts in an upward direction the guide 28 will sufficiently hold the column 24 so that it will not lift off support plate 18.

Figure 1:
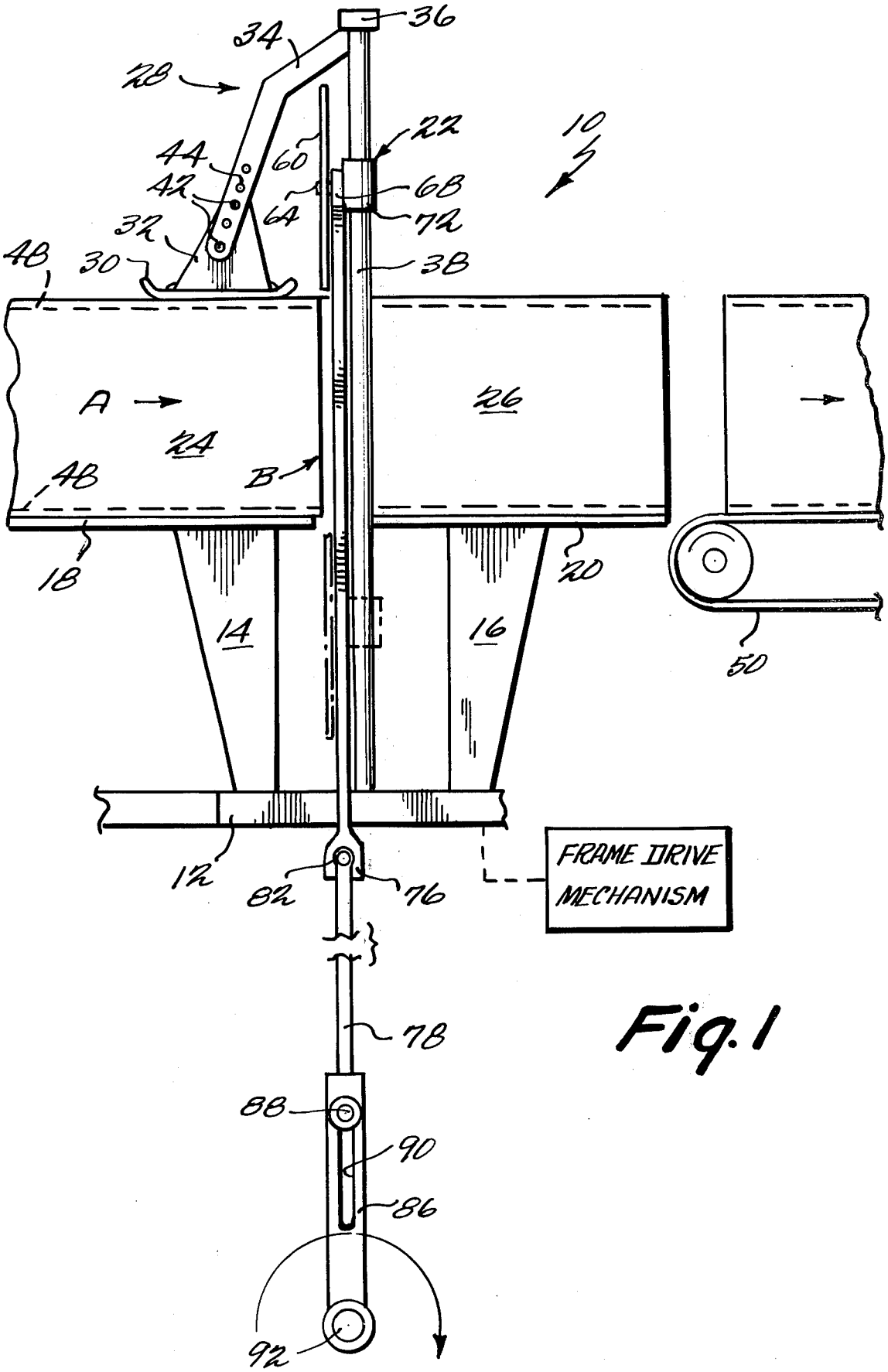
FIG. 1 is a fragmentary side elevational view of the split tile cutter according to one embodiment of the present invention with cutting tools shown in their upward position and a phantom showing of the cutting tools in their down position.

The hollow wall split tile column 24 is constantly moving during the extrusion process and therefore to index the cutting assembly 22 to a proper position in order to cut column pieces such as 26, the frame 12 together with the cutting assembly 22 will be moved in a direction counter to the direction indicated by arrow A or back to a predetermined starting position by the frame drive mechanism set forth in FIG. 1 in the titled box. Since such drive mechanisms are known and described in the above referenced patents and applications, further explanation herein is not deemed necessary for a complete understanding of the invention. By so moving frame 12, the cutting assembly 22 will be properly indexed to a preselected point so that the next column piece can be cut. Column pieces which have been cut, such as is shown at 26, will be subsequently pushed onto a conveyor 50 for transport to a transfer device (not shown) by the next pieces being cut since clay column 24 continues to move in the direction shown by arrow A. The incremental movements of frame 12 will usually be small so that cut pieces 26 can continue to rest on plate 20. However, known conveyor systems can also be used which would move with frame 12 so that as it is indexed backward to a new cut cycle position the conveyor end, held by spring loaded rollers, can move with that frame and in the same direction in order to receive the previously cut column pieces.

Figure 2:
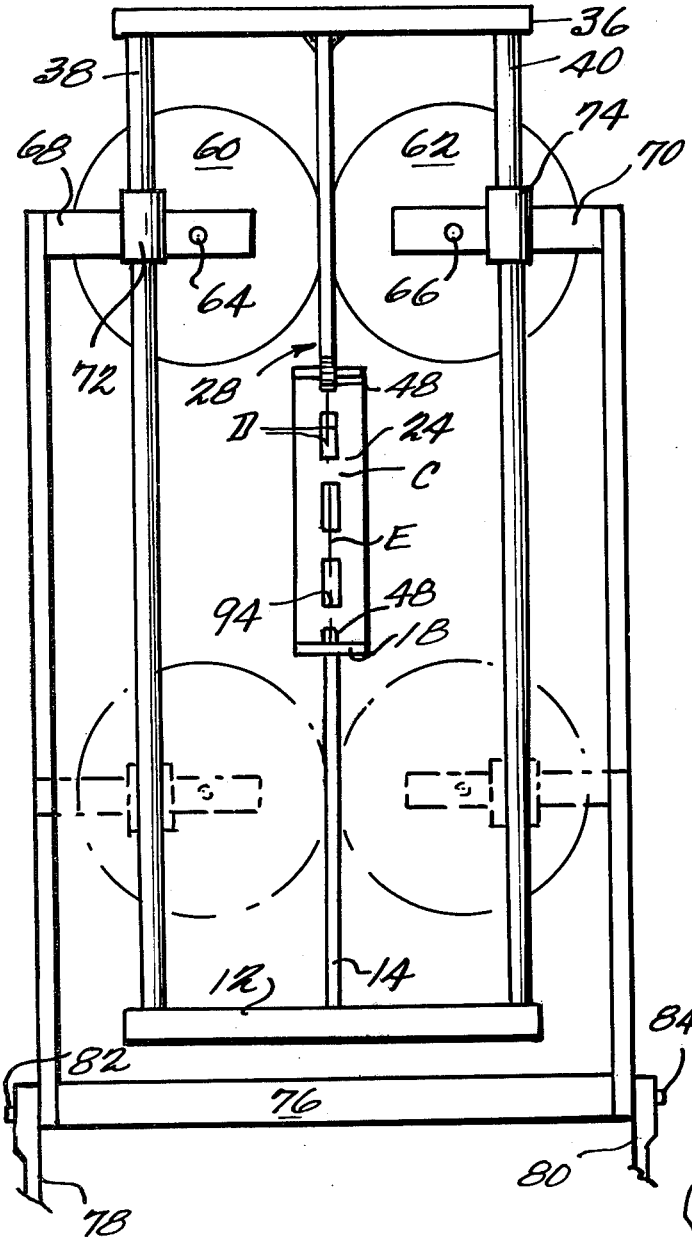
FIG. 2 is a partial end elevational view of the split tile cutter shown in FIG. 1.

The cutting assembly 22 includes two disc cutters 60 and 62 rotatably mounted on pins 64 and 66 which are each respectively secured in holding bars 68 and 70. Holding bars 68 and 70 are, respectively, secured to slide bushings 72 and 74 each of which is slidably retained on guide rods 38 and 40. The free upright ends of the U-shaped stirrup member 76 are respectively secured to the outer portions of holding bars 68 and 70 so that those upright legs of stirrup 76 are positioned outwardly of guide rods 38 and 40 while the horizontal member of stirrup 76 joining the upright legs together lies below frame 12. In FIG. 2, the cutting assembly 22 is shown in full line at the top of its upward stroke while the bottom of the cutting assembly, downward stroke is partially shown in phantom lines.

Drive rods 78 and 80 are pivotally connected to stirrup member 76 by lugs 82 and 84 projecting outwardly from the sides of the bottom portion of stirrup 76. Drive rod 78 and 80 are, each in turn, connected to crank arms 86 by means of a follower 88 operating within a cam slot 90 formed in crank arms 86. Crank arms 86 are secured in any suitable fashion to a rotatably powered shaft 92, powered by any convenient means such as an electric motor and drive belt system (not shown).

The apparatus according to the first embodiment of the present invention having been described, its operation will now be set forth. A continuously moving split tile clay column 24 coming from the extruder (not shown) is intercepted and supported by support plates 18 and 20. As indicated, the cutting assembly 22 as well as support plates 18 and 20 and the frame 12 are all connected together and during a cutting cycle will be moved by a conventional drive mechanism, indicated by the labeled box in FIG. 1. Such a drive mechanism will serve to index the frame rearwardly to a new start cycle position and will also serve to move the frame and cutting assembly at approximately the same speed as the clay column moves from the extruder so that during the cutting cycle there is no relative movement between the frame 12 and cutting assembly 22 and the clay column 24. With the cutting assembly 22 and frame 12 in its predetermined cutting position and while they move along with the column 24 the powered shaft 92 is actuated causing the cutting assembly 22, in particular cutting knives 60 and 62, to move from the position shown in full lines in FIG. 2 down through the column 24 to the position shown in phantom in FIG. 2 corresponding to the bottom of a downward cutting stroke. Conversely, if an upward cutting stroke were being made the cutting disc 60 and 62 would begin in a position as shown in phantom in FIG. 2 and move upwardly through the column 24 to the position shown in full line which constitutes the top of the upward cutting stroke. FIG. 1 shows the relative position of the elements following the completion of an upward cutting stroke and with the cutting assembly 22 in the position as shown the frame 12 will be moved in a direction opposite to the movement of arrow A or opposite to the machine direction in which the clay column 24 moves to a predetermined original position in preparation for the next cutting cycle whereupon the whole cycle may be performed again. The column piece 26 which has now been severed from column 24 but will remain at least in part supported by support plate 20. As previously indicated, the cut pieces can be supported by conveyor 50 which can be in the form of a spring-loaded conveyor system tied to frame 12 so that it would move rearwardly along with frame 12 when frame 12 was moved back a starting position following a cutting cycle.

Since the cutting stroke is guided in a vertical direction by guide rods 38 and 40, the cutting stroke will be extremely straight and even. The dimensions of the hollow wall split tile clay column 24 will usually vary from about one to one and three-quarters inches in width and from four to twelve inches in height so that column 24 is a relatively narrow but high extruded column. It should be understood, however, that the above sizes for column 24 are exemplary as such columns could be higher than these as well as wider or narrower depending upon the exact nature and type of split tiles being formed.

In this embodiment, the cutting of column 24 is accomplished by means of a pair of disc cutters 60 and 62. Column 24 is provided with internal centrally located ribs C separated by open spaces or holes 94. Line E represents the vertical axis of column 24. In order to fully sever column pieces 26 from the column 24 it is important for the disc cutters 60 and 62 to have their peripheral edges just touching each other if the discs 60 and 62 lie in the same plane so that each disc would cut up to Line E. Alternatively, discs 60 and 62 could lie in planes slightly offset from one another in a horizontal direction so that the peripheral edges of the discs could overlap slightly so that each edge would then cut slightly beyond the vertical axis E of column 24. In either instance, the positioning of discs 60 and 62 should be such that the width of column 24 be completely cut through by the combined action of cutting discs 60 and 62.

It should be understood that cutting discs 60 and 62 can be made from a wide variety of materials corresponding to the type of clay material being extruded. The discs could be made of a steel or steel-like material, and in some instances, it may also be either necessary or desirable to coat the discs such as, for example, with a Teflon coating. Since the widths of the extruded clay columns will usually vary from about one to one and three-quarters inches, discs 60 and 62 can have a diameter, for example, of from about 4 to about 6 inches depending, of course, where the discs are mounted to holders 68 and 70. It should be understood that each of the discs enters column 24 for only half of the width or just a small amount in addition to that if the discs are arranged in an overlapping relationship and it is this amount of column penetration which will, for the most part, establish the disc size needed.

Figure 3:
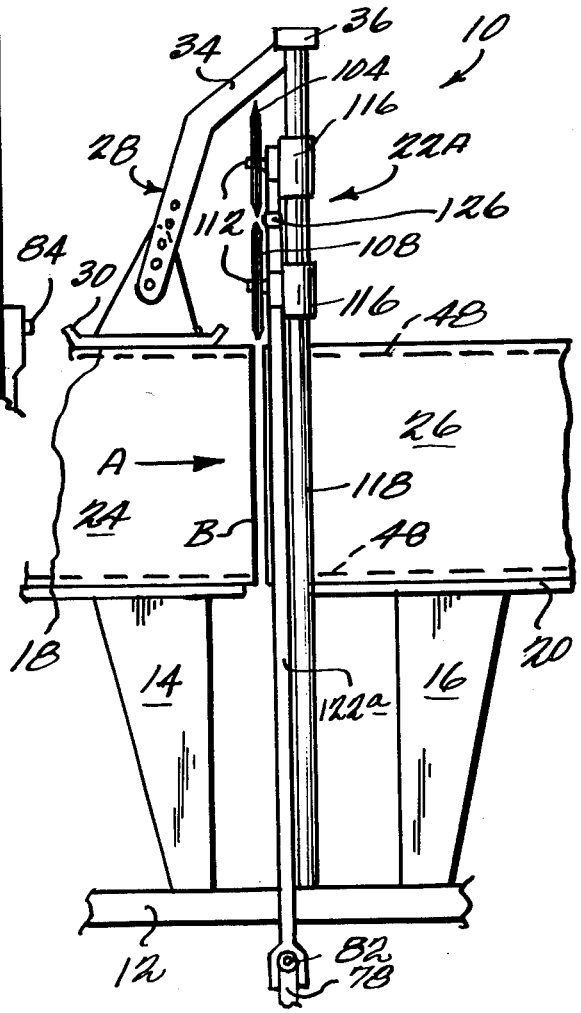
FIG. 3 is a fragmentary side elevational view of another embodiment of the split tile cutter according to the present invention having a following wire for cutting the very central portion of the extruded column comprised of the ribs and back edge of the tiles.
Figure 4:
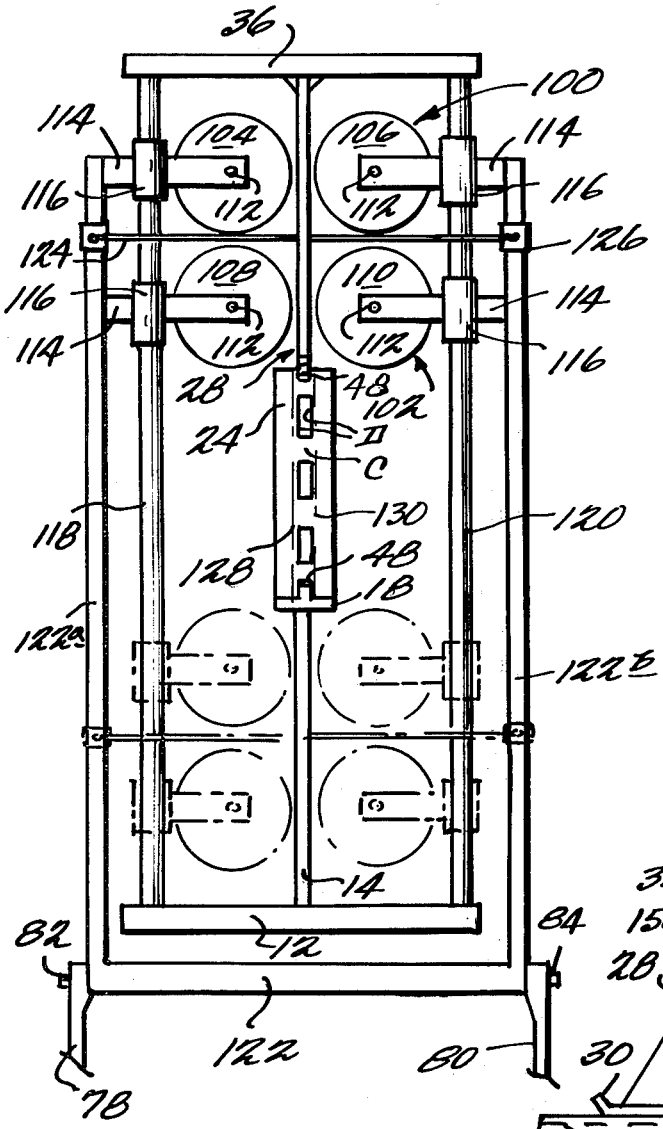
FIG. 4 shows a partial end elevation of the split tile cutter embodiment shown in FIG. 3.

Turning now to the second embodiment of the present invention reference is made to FIGS. 3 and 4 where again frame 12 serves to support plates 18 and 20 by means of vertical supports 14 and 16. The hollow wall split tile clay column 24 is again moving in a machine direction indicated by arrow A and is guided at the top by means of a top guide member 28. Cut pieces 26 will again appear on the right hand side of the cutting assembly, which in this embodiment has been modified and is now generally indicated by numeral 22A. Certain types of extruded hollow wall split tile clay columns may have very complicated rib designs on the back of the tiles or rib structures may be extremely thin so that any openings formed thereby are extremely marginal in width. In addition, the ribs themselves may well have a variety of shapes or may be round and it would be undesirable to in any way squeeze or deform such ribs or rib structures. Further, with very plastic or sticky clays it might be possible to cause the openings in the center of the column between split tiles to be closed if cutting devices were pushed into the middle of such extrusions since to do so might cause the clay material to stick together thereby closing the holes. If the holes were closed, there would be no air movement or moisture movement between the tiles during subsequent drying and firing which may well cause the tiles, on drying to be deformed or bent. In these instances, where the rib structure in the center of the extrusion is very weak or fragile or where the design is complicated, I have found that using the rotary cutters as described hereinbefore to make a major primary cut through the majority of the column's total width and a following secondary cutter to finish the cutting of only a very small width at the very center of the column all in one cutting stroke works extremely well. One example of such a modified cutting arrangement is shown in the second embodiment, specifically in FIGS. 3 and 4. Two sets of paired cutting discs, shown generaly at 100 and 102, are employed with set 100 comprised of discs 104 and 106 while set 102 is comprised of discs 108 and 110. Each of these discs is rotatably supported on a shaft 112 which itself is secured in a holding bar 114. Each of the holding bars 114 is mounted to a slide bushing 116 slidably mounted on guide rods 118 and 120 which are slightly longer in length than guide rods 38 and 40 described in the first embodiment. In addition, a stirrup 122, similar to stirrup 76 in the first embodiment, longer upright legs **122*a* and 122*b* in order to be of a suitable size to be attached to each of the holding bars 114 in each set of cutting discs. This following cutter is comprised of a wire cutter 124, mounted in the same plane as and between the pairs of cutting discs 100 and 102 by means of clamps 126 secured to the upright legs 122*a* and 122*b* of stirrup 122. With wire cutter 124 positioned between the pairs of cutting discs 100 and 102, all of which lie in the same plane, wire 124 will act in a following manner on both upward and downward cutting strokes and will cut that very narrow portion of column 24 remaining uncut following the passage therethrough of either set of cutting discs 100 or 102**.

It should be noted that each of the cutting discs in pairs 100 and 102 are spaced apart and do not cut the very center of column 24. As was indicated above, in some extrusion designs it is not desirable to in any way cause deformation of the interior structure. The rear surface of the split tiles is indicated by the leter D and it will be noted that the cutting stroke of each set of discs does not extend beyond a line established by the rear surfaces D but rather falls just short thereof. The inward limit of the cutting stroke for the discs is represented by the vertical dotted lines 128 and 130 which pass down through column 24 and just to the outside of rear surface D. Therefore, the portion of column 24 remaining uncut lies between vertical lines 128 and 130 and it is this portion cut by wire 124. Because of the relative thinness of the uncut area between lines 128 and 130 there is extremely little resistance to the passage therethrough of wire 124 so that the line of least resistance followed by that wire lies in a plane directly in line with cutting discs 108 and 110 on a downward stroke or 104 and 106 on un upward stroke. Since wire 124 is thinner than cutting discs 104–110 any deformation or smudging of the visible edges of the tiles is, accordingly, avoided.

Figure 5:
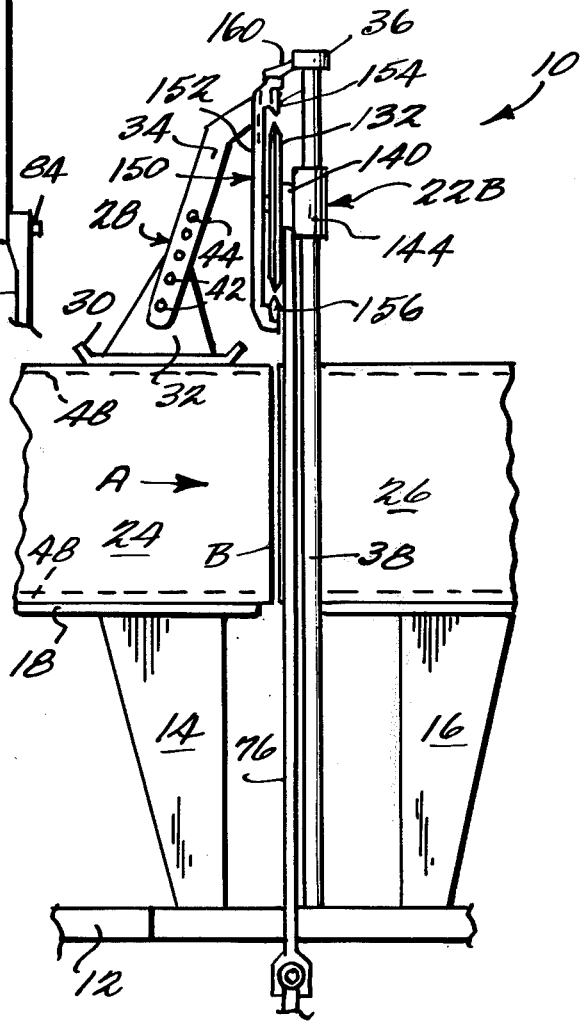
FIG. 5 is a fragmentary side elevational view of still another embodiment of the present invention wherein the split tile cutter is provided with pivoting knives which act in a following manner to cut the very central portion of the extruded column comprised of the ribs and back edge of the tile.
Figure 6:
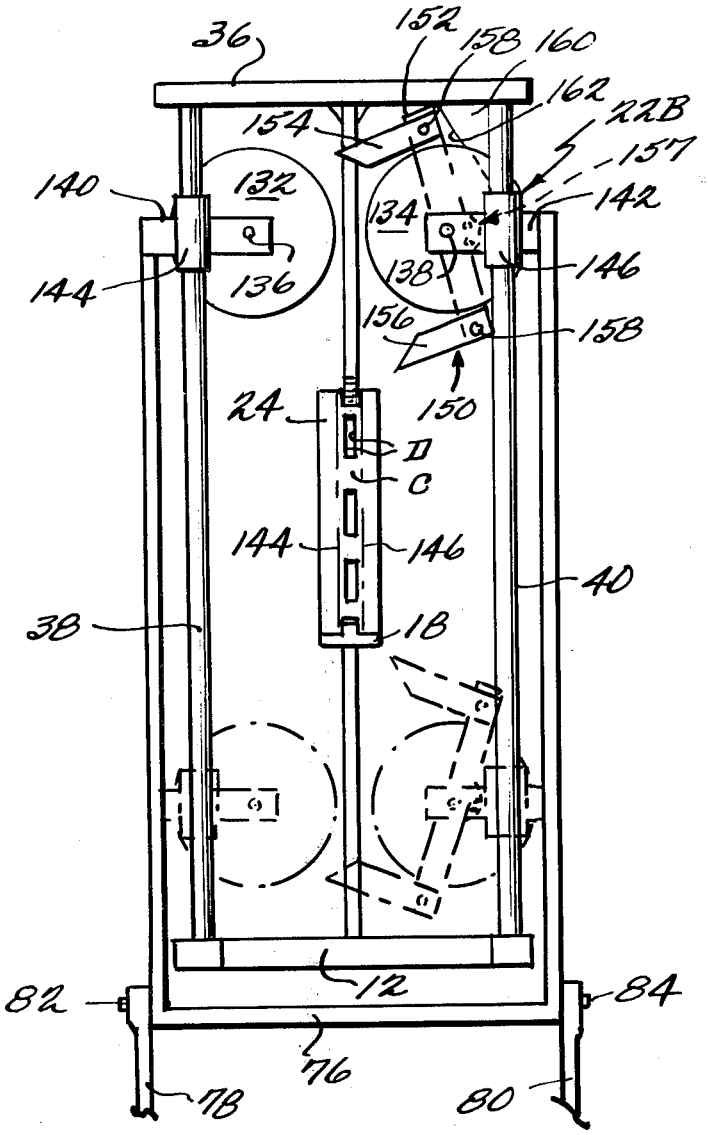
FIG. 6 is a partial end elevational view of the split tile cutter embodiment shown in FIG. 5.

Turning now to still another embodiment of the present invention and with reference to FIGS. 5 and 6, the primary portions of the apparatus remain as described with respect to the first embodiment in that the frame 12, by means of supports 14 and 16, serves to support plates 18 and 20 on which the clay column 24 and the column piece 26 are supported. The top guide member 28 is also employed and again is connected to frame 12 through the top horizontal frame member 36 the latter being secured to guide rods 38 and 40. The cutting assembly, indicated generally by numeral 22B, includes cutting discs 132 and 134, are rotatably connected to pins 136 and 138 secured in holders 140 and 142. Holders 140 and 142 are suitable secured to slide bushings 144 and 146 slightly mounted on guide rods 38 and 40. As was the case in the first embodiment, cutting discs 132 and 134 rotatably mounted are on pins 136 and 138 so that they can freely rotate due to the friction created as they pass through clay column 24. As was the case with the second embodiment, this third embodiment is designed to be employed with clay columns in which the central portion of the extrusion is extremely fragile or where it is undesirable to have the cutting discs cut all the way through the column. Accordingly, in this embodiment, the cutting discs 132 and 134 are again spaced apart a distance such that they will cut the majority of the width of column 24 but will not cut through the rear surface D of either split tile. Cut lines for discs 132 and 136 are indicated at 144 and 146. Rather than using a following wire as was the case in the second embodiment shown in FIGS. 3 and 4, this third embodiment makes use of a following knife assembly generally indicated at 150 comprised of a pivoting arm 152 pivotally connected on to pin 138 and having knife-blades 154 and 156 suitably secured at each end as by bolts 158. Knife-blade 154, as shown in FIG. 6, is in position for the next down stroke cutting cycle whereas the phantom representation of discs 132 and 134 shows that knife 156 has been pivoted into its cutting position in preparation for the next upward cutting stroke. Knives 154 and 156 are positioned on pivot arm 152, as shown in FIG. 5, so as to lie in the same plane as discs 132 and 134 and since knives 154 and 156 are thinner than discs 132 and 134 the passage of such knives through the very thin uncut portion of column 24, represented between lines 128 and 130, can be easily cut by such knives without any deformation occurring to the previously cut tile edges.

Pivot arm 152, as indicated in FIG. 6, must be moved between the two positions shown, one in full lines and one in phantom lines in order to properly function as a following cutter. Movement of arm 152 can be accomplished by a variety of means, such as a drive cylinder and drive arm connected between the arm 152 and holder 142. Such a cylinder could be either an air on pneumatic-type, operated by a suitable means, such as a solenoid operated valve which could be controlled by trip means contacted when the cutting assembly arrived at either its top or bottom position. Likewise, the pivot arm 152 could be held in its cutting position by two separate spring biased balls and a detent arrangement generally indicated at 157. The balls held by holder 142 and the detent in arm 152 would allow for movement between each of the two positions shown in FIG. 6, with movement of pivot on 152 from one position to the other being accomplished by means of a pivot member 160 provided at end of the stroke path having a caming service 162 for moving pivot arm 152 into position for the next stroke. Movement of the pivot arm 152 would be accomplished as the cutting assembly 22B approached either its top or bottom position. As was the case with the other two embodiments, the operation of the apparatus in its cutting cycle as well as the movement of frame 12 is the same in each of two additional embodiments as was described for the first embodiment shown in FIGS. 1 and 2.

It should also be understood that a plurality of the above described cutting assemblies could be positioned along the length of the path followed by the extruded column at predetermined distances from one another so that several cuts along the length of the column could be made simultaneously.

While the present invention has been described in connection with several embodiments, it is to be understood that this invention is not to be limited to these disclosed embodiments but rather, on the contrary, it is intended to cover other various modifications and equivalent arrangements included within the spirit and scope of the appended claims.

What is claimed is:

1. Apparatus for cutting an extruded column of plastic material into segments comprising cutting means positioned on opposite sides of the column for cutting the extruded plastic column into segments without tearing the outer surface thereof, said cutting means arranged to move alternately back and forth with respect to said column between first and second positions with each alternate movement between said first and second positions comprising a cutting stoke, cutting device means for moving said cutting means between said first and second positions, frame means for supporting said cutting means and at least that portion of said column adjacent the cut, frame drive means for moving said frame and cutting means with respect to said column prior to and during each cutting stroke.

2. Apparatus for cutting an extruded column of plastic material into segments comprising cutting means for cutting the extruded plastic column into segments without tearing the outer surface thereof, said cutting means arranged to move alternately back and forth with respect to said column between first and second positions with each alternate movement between said first and second positions comprising a cutting stroke, cutting drive means for moving said cutting means between said first and second positions, frame means for supporting said cutting means and at least that portion of said column adjacent the cut, frame drive means for moving said frame and cutting means with respect to said column prior to and during each cutting stroke, wherein said cutting means includes a pair of cutting members, means for mounting each of said cutting members oppositely from one another so that each will cut into said column from opposite sides thereof during each cutting stroke, said mounting means being movably secured to said frame means and operatively connected to said cutting drive means.

3. Cutting apparatus as in claim 2, wherein said frame means includes guide means for guiding the movement of said mounting means when moved by said cutting drive means during each cutting stroke.

4. Cutting apparatus as in claim 2, wherein said cutting members comprise cutting discs.

5. Cutting apparatus as in claim 4, wherein said cutting discs are positioned in a plane perpendicular with respect to the sides of said column and positioned so that each cuts through at least one half of the thickness of said column.

6. Cutting apparatus as in claim 4, wherein said cutting discs are positioned directly adjacent one another in separate spaced apart planes so that said discs can overlap one another.

7. Cutting apparatus as in claim 4, wherein said extruded column comprises a hollow walled split tile column having a center portion including the rear surface of the split tiles comprising said column and a rib structure joining said rear surfaces, and wherein said cutting discs are spaced apart a distance at least equal to the thickness of said ribs and the rear surfaces of said split tiles and wherein said cutting means further includes secondary cutting means for following said cutting discs on each cutting stroke and for cutting that portion of said column remaining uncut by each of said pairs of discs.

8. Apparatus for cutting an extruded column into segments comprising cutting means for cutting the extruded column into segments, said cutting means arranged to move alternately back and forth with respect to said column between first and second positions with each alternate movement between said first and second positions comprising a cutting stroke, cutting drive means for moving said cutting means between said first and second positions, frame means for supporting said cutting means and at least that portion of said column adjacent the cut, frame drive means for positioning said frame and cutting means with respect to said column prior to and during each cutting stroke, wherein said extruded column comprises a hollow walled split tile column having a center portion including the rear surfaces of the split tiles comprising said column and a rib structure joining said rear surfaces, said cutting means including a movable cutting frame member movably secured to said frame means and connected to said cutting drive means, first cutting means mounted to said frame member comprising two pairs of cutting discs, spaced apart in the direction of the cutting stroke, each pair of cutting discs being mounted so that the discs in each pair are positioned oppositely from one another so that each disc in one of said pairs will cut into said column from opposite sides thereof during one cutting stroke and so that each disc in the other of said pairs will cut into said column from opposite sides thereof during the next cutting stroke, the discs within each of said pairs being spaced apart a distance at least equal to the thickness of said ribs and the rear surfaces of said split tiles and second cutting means positioned between said two pairs of cutting discs for cutting that portion of the column remaining uncut by each of said pairs of discs.

9. Cutting apparatus as in claim 8, wherein said second cutting means comprises a wire cutter mounted to said movable cutting frame member so as to be in the same plane as said pairs of cutting discs and to extend across said column.

10. A method of cutting an extruded column of a plastic material as it is extruded along a path comprising the steps of indexing a cutting assembly to a starting position along said extrusion path and while moving the cutting assembly with said extruded column so that there is not relative motion therebetween cutting the column from opposite sides substantially simultaneously without tearing the outer surface of the column by moving the cutting assembly in a first direction from a first position on one side of the column to a second position on the other side thereof, thereafter indexing the cutting assembly along the extrusion path in a direction opposite to the extrusion direction back to the start position and while again moving the cutting assembly with the extruded column so that there is no relative motion therebetween and cutting the column by moving the cutting assembly in a second direction from the second position back to the first position.

11. A method as in claim 10, wherein movement of the cutting assembly in the first direction is downwardly through the column and movement in the second direction is upwardly through the column.

12. A method of cutting an extruded split tile column extruding a split tile column along a path comprising the steps of indexing a cutting assembly to a starting position along said extrusion path and while moving the cutting assembly with said extruded column so that there is no relative motion therebetween cutting the column by moving the cutting assembly in a first direction from a first position on one side of the column to a second position on the other side thereof, thereafter indexing the cutting assembly along the extrusion path in a direction opposite to the extrusion direction back to the start position and while again moving the cutting assembly with the extruded column so that there is no relative motion therebetween and cutting the column by moving the cutting assembly in a second direction from the second position back to the first position wherein the cutting assembly on each cutting stroke includes a pair of oppositely mounted disc-like cutters positioned directly in line with the column and which are spaced apart a predetermined distance and a following cutter extending at least across the area between the spaced apart disc-like cutters, and wherein the step of cutting includes the steps of moving the pair of disc-like cutters through the column so as to cut across the thickness of the column from the opposite sides thereof except for a predetermined area in the center thereof corresponding in thickness to the space between the disc-like cutters and thereafter cutting the uncut central area with the following cutter.

13. Apparatus for cutting an extruded column of plastic material comprising:

a frame;

cutting means mounted on opposite sides of the extruded column and arranged to move alternatively back and forth between first and second positions for cutting the plastic column substantially simultaneously along opposite sides thereof without deforming the column along the cut line during each of those movements;

first guide means mounted on said frame for guiding the cutting means during cutting;

support means for supporting the extruded column during the cutting strokes, said support means allowing movement of the cutting means between said first and second positions; and cutting drive means for driving said cutting means between said first and second positions.

14. A method of cutting an extruded column of a plastic material as it is extruded along a path comprising the steps of indexing a cutting assembly to a starting position along said extrusion path and while moving the cutting assembly with said extruded column so that there is no relative motion therebetween cutting the column without tearing the outer surface of the column by moving the cutting assembly in a first direction from a first position on one side of the column to a second position on the other side thereof, thereafter indexing the cutting assembly along the extrusion path in a direction opposite to the extrusion direction back to the start position and while again moving the cutting assembly with the extruded column so that there is no relative motion therebetween and cutting the column by moving the cutting assembly in a second direction from the second position back to the first position, wherein said cutting assembly includes at least a pair of oppositely mounted disc-like cutters positioned directly in line with the column and said cutting includes the step of rolling the pair of disc-like cutters through the column so as to cut the column from the opposite sides thereof.

15. Apparatus for cutting an extruded column of plastic material comprising:

a frame;

cutting means arranged to move alternately back and forth between first and second positions for cutting the plastic column without deforming the column along the cut line during each of those movements, said cutting means including a pair of undriven, cutting discs;

first guide means mounted on said frame for guiding the cutting means during cutting;

support means for supporting the extruded column during the cutting strokes, said support means allowing movement of the cutting means between said first and second positions; and cutting drive means for driving said cutting means between said first and second positions.

16. A method as in claim 15, wherein each disc cuts at least half of the column's thickness.

17. Cutting apparatus as in claim 15 further including means for positioning each of said cutting discs oppositely from one another so that each will cut into said column a predetermined amount from opposite sides thereof during each cutting stroke, said positioning means being movably secured to said frame and connected to said cutting drive means.

18. A method of cutting an extruded column of a plastic material without tearing the outer surface thereof, comprising the steps of (i) indexing a cutting assembly employing oppositely mounted undriven cutting discs to a starting position along the extrusion path of said column and while moving the cutting assembly with said extruded column so that there is no relative motion therebetween cutting the column by rolling oppositely mounted, undriven cutting discs in a first direction from a first position on one side of the column through the column to a second position on the other side thereof; (ii) thereafter indexing the cutting assembly along the extrusion path in a direction opposite to the extrusion direction back to the starting position; and (iii) while again moving the cutting assembly with the extruded column so that there is no relative motion therebetween cutting the column by rolling the cutting discs in a second direction from the second position through the column back to the first position.

* * * * *